343-700 MS AU 256 EX
4/8/80 OR 4,197,544

United States Patent [19]
Kaloi

[11] 4,197,544
[45] Apr. 8, 1980

[54] WINDOWED DUAL GROUND PLANE MICROSTRIP ANTENNAS

[75] Inventor: Cyril M. Kaloi, Thousand Oaks, Calif.

[73] Assignee: The United States of America as represented by the Secretary of the Navy, Washington, D.C.

[21] Appl. No.: 837,058

[22] Filed: Sep. 28, 1977

[51] Int. Cl.[2] ..... H01Q 1/48
[52] U.S. Cl. ..... 343/700 MS; 343/846
[58] Field of Search ..... 343/700 MS, 829, 830, 343/846, 767–769, 854, 795, 708

[56] References Cited

U.S. PATENT DOCUMENTS

| | | | |
|---|---|---|---|
| Re. 29,296 | 7/1977 | Krutsinger et al. | 343/700 MS |
| 3,665,480 | 5/1972 | Fassett | 343/700 MS |
| 3,947,850 | 3/1976 | Kaloi | 343/846 |
| 4,063,246 | 12/1977 | Greiser | 343/700 MS |
| 4,072,951 | 2/1978 | Kaloi | 343/846 |

*Primary Examiner*—David K. Moore
*Attorney, Agent, or Firm*—Richard S. Sciascia; Joseph M. St. Amand

[57] ABSTRACT

Microstrip antenna systems having two ground planes spaced apart by a dielectric substrate and radiating elements coplanar with one of the two ground planes, or sandwiched within the dielectric substrate separating the two ground planes adjacent a window in one of the ground planes. The two ground planes are shorted together in most instances, and the dual ground plane system provides a reduction in the leakage losses of transmission lines feeding and/or interconnecting the microstrip antenna radiating elements. The dual ground plane system also provides a reduction in coupling between arrayed radiation elements as well as an increase in bandwidth, in some instances.

37 Claims, 34 Drawing Figures

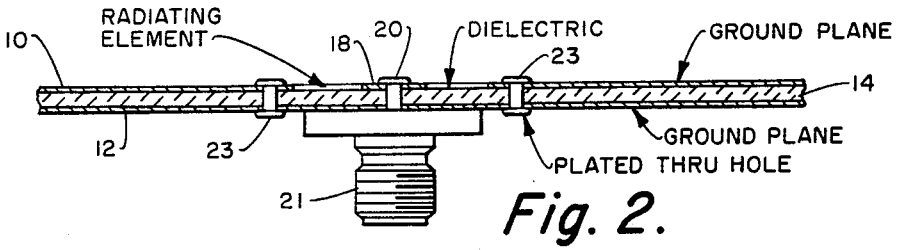
Fig. 2.
Fig. 1.
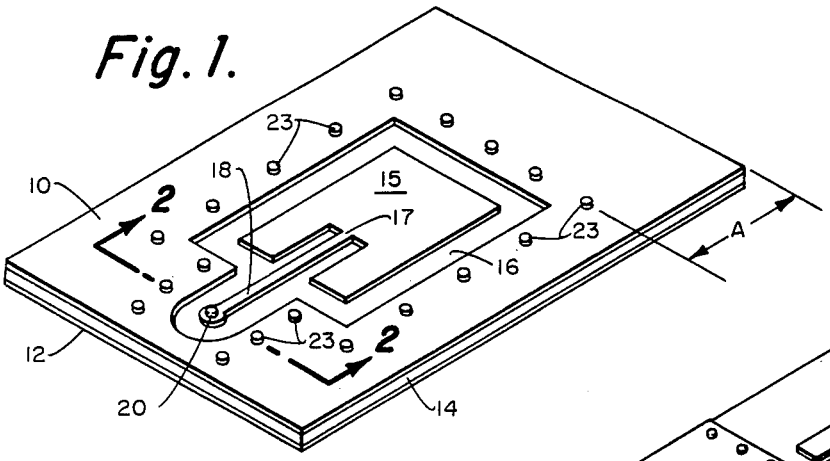
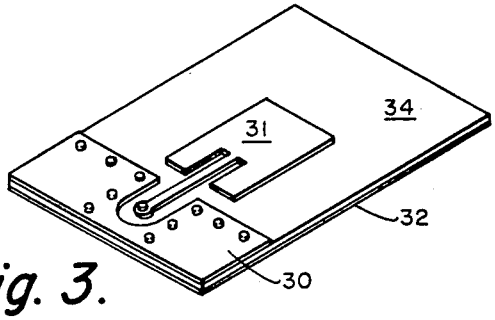
Fig. 3.
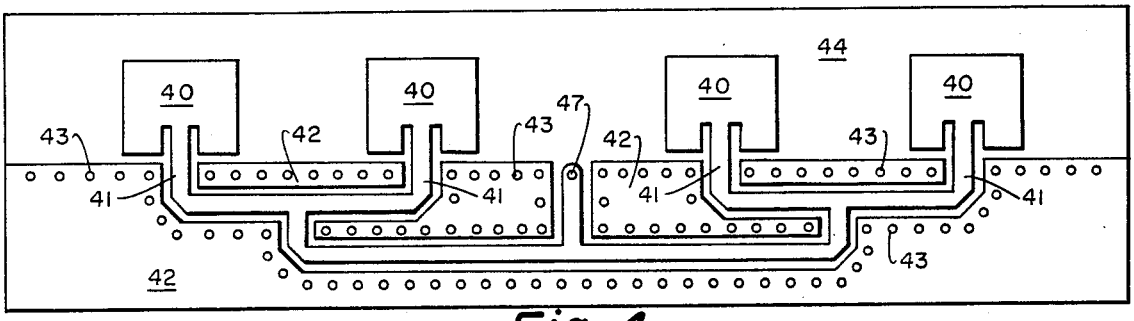
Fig. 4.
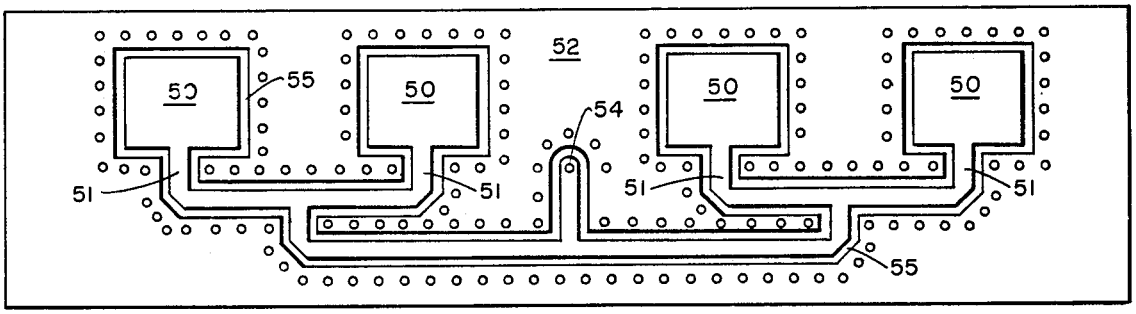
Fig. 5.

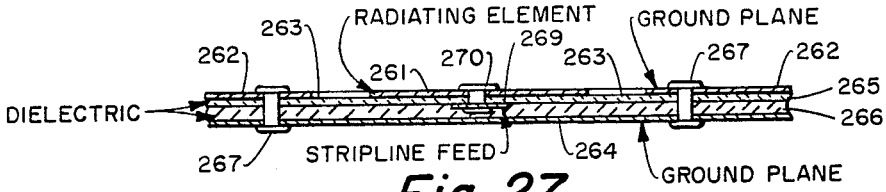
Fig. 27.
Fig. 26.
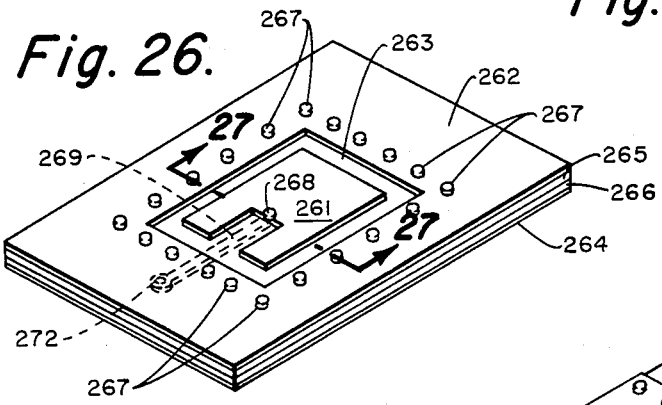
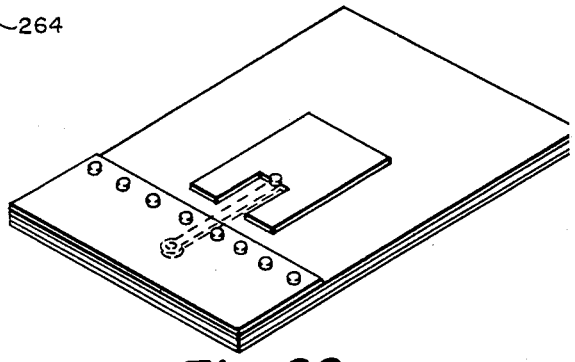
Fig. 28.
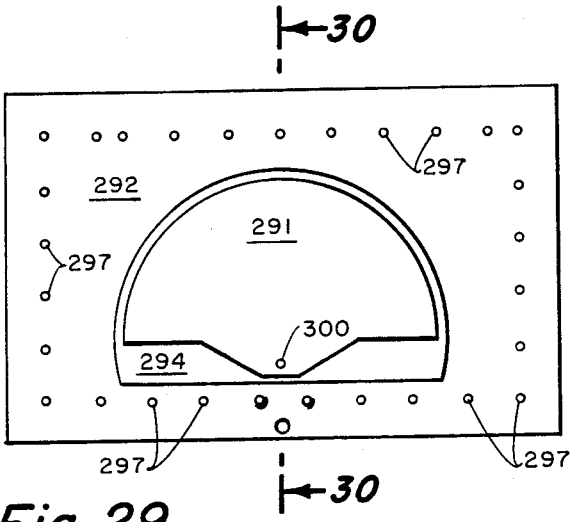
Fig. 29.
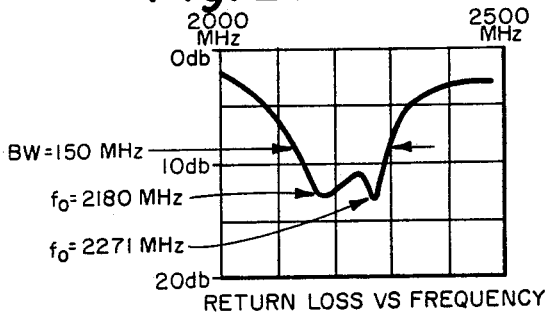
Fig. 31.
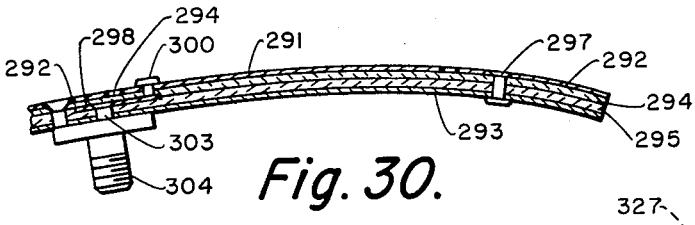
Fig. 30.
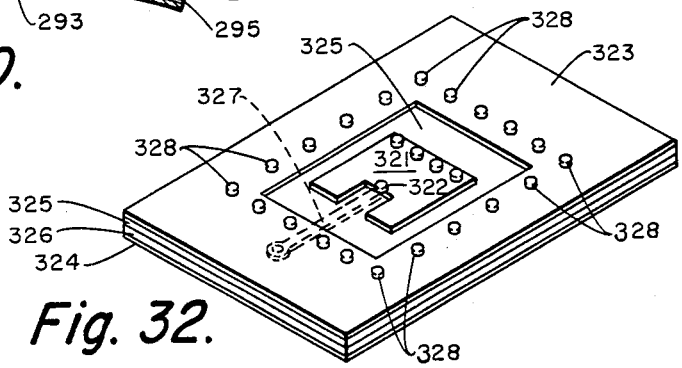
Fig. 32.

WINDOWED DUAL GROUND PLANE MICROSTRIP ANTENNAS

CROSS REFERENCES TO RELATED PATENTS AND APPLICATIONS

This invention is related to U.S. Pat. No. 3,947,850 issued Mar. 30, 1976 for NOTCH FED ELECTRIC MICROSTRIP DIPOLE ANTENNA; U.S. Pat. No. 3,978,488 issued Aug. 31, 1976 for OFFSET FED ELECTRIC MICROSTRIP DIPOLE ANTENNA; U.S. Pat. No. 3,972,049 issued July 27, 1976 for ASYMMETRICALLY FED ELECTRIC MICROSTRIP ANTENNA; U.S. Pat. No. 3,984,834 issued Oct. 5, 1976; U.S. Pat. No. 3,972,050 issued July 27, 1976 for END FED ELECTRIC MICROSTRIP QUADRUPOLE ANTENNA; U.S. Pat. No. 3,978,487 issued Aug. 31, 1976 for COUPLED FED ELECTRIC MICROSTRIP DIPOLE ANTENNA; and U.S. Pat. No. 4,040,060 issued Aug. 2, 1977 for NOTCH FED MAGNETIC MICROSTRIP DIPOLE ANTENNA; all by Cyril M. Kaloi and commonly assigned.

This invention is also related to copending U.S. patent applications: Ser. No. 740,695 for ASYMMETRICALLY FED MAGNETIC MICROSTRIP DIPOLE ANTENNA, now U.S. Pat. No. 4,095,227 issued June 13, 1978; Ser. No. 740,693 for OFFSET FED MAGNETIC MICROSTRIP DIPOLE ANTENNA, now U.S. Pat. No. 4,078,237 issued Mar. 7, 1978; Serial No. 740,691 for COUPLED FED MAGNETIC MICROSTRIP DIPOLE ANTENNA, now U.S. Pat. No. 4,069,483 issued Jan. 17, 1978; Ser. No. 740,694 for ELECTRIC MONOMICROSTRIP DIPOLE ANTENNAS, now U.S. Pat. No. 4,083,046 issued Apr. 4, 1978; Ser. No. 740,696 for NOTCHED/DIAGONALLY FED ELECTRIC MICROSTRIP DIPOLE ANTENNA, now U.S. Pat. No. 4,051,478 issued Sept. 27, 1977; Ser. No. 740,692 for NOTCHED/DIAGONALLY FED ELECTRIC MICROSTRIP ANTENNAS, now U.S. Pat. No. 4,067,016 issued Jan. 3, 1978; and Ser. No. 740,690 for NOTCH FED TWIN ELECTRIC MICROSTRIP DIPOLE ANTENNAS, now U.S. Pat. No. 4,072,951 issued Feb. 7, 1978; all filed on Nov. 10, 1976, by Cyril M. Kaloi, and commonly assigned. This invention is also related to copending U.S. patent applications: Ser. No. 571,152 for CORNER FED ELECTRIC MICROSTRIP DIPOLE ANTENNA, filed Apr. 24, 1975 now abandoned, and Ser. No. 712,994 for MULTIPLE FREQUENCY MICROSTRIP ANTENNA ASSEMBLY, filed Aug. 9, 1976, and now U.S. Pat. No. 4,074,270 issued Feb. 14, 1978, by Cyril M. Kaloi and commonly assigned.

BACKGROUND OF THE INVENTION

The present invention is related to microstrip antennas and involves the use of two ground planes. Prior microstrip antennas comprise a radiating element separated from a single ground plane by a dielectric layer, and such prior microstrip antennas are fully described in the aforementioned related patents and patent applications. The microstrip antennas are made by well known circuit board techniques.

Transmission line leakage losses, i.e., current losses, are involved in transmission lines used for interconnecting microstrip antenna elements and arrays, such as those types disclosed in the aforementioned related patents and patent applications. Prior to the present invention there were no satisfactory means for eliminating or reducing these transmission line losses in microstrip radiating element feedlines or interconnecting feedlines for microstrip antenna arrays.

SUMMARY OF THE INVENTION

In the present invention, two ground planes are separated by a dielectric substrate. In several embodiments, one of the ground planes has a radiating element formed coplanar therewith by having a portion thereof, generally following the outline of the radiating element, removed from the ground plane conductive surface. The conductive ground planes are usually shorted together by rivets, or electroplated-thru-holes, etc. In other embodiments, however, the radiating element is within the dielectric substrate between the two ground planes and radiates through a window in one of the ground planes; these embodiments can operate without shorting the two ground planes together, although in the majority of instances it is recommended that both ground planes be electrically connected to the flange of the coaxial-to-stripline launcher. The radiating elements are fed with either coplanar microstrip transmission lines or stripline transmission lines as described herein. These microstrip antennas use a very thin laminated structure which can readily be mounted on flat or curved, irregular structures or surfaces, and thus operate to present a low physical profile where minimum aerodynamic drag is required or desired. In addition, these antennas can be arrayed with the various types of transmission lines as hereinafter described, and can be photo-etched simultaneously on a dielectric substrate using well known printed circuit techniques, as also discussed in the cross-referenced patents and applications along with design equations, etc. for individual antenna radiating elements. The thickness of the dielectric substrate separating the two ground planes should be much less than $\frac{1}{4}$ wavelength.

There are actually six families or groups of dual ground plane antennas which operate to reduce transmission line losses, as well as, in some instances, increase the bandwidth and reduce any coupling between two or more elements; also, each family can be subdivided into various antenna types that provide additional improvements over other types by virtue of changing the feedpoint. These various families or groups of dual ground plane antenna types are: the coplanar-fed electric microstrip antennas; the coplanar-fed magnetic microstrip antennas; the stripline-fed windowed electric microstrip antennas; the stripline-fed windowed magnetic microstrip antennas; the stripline-fed electric microstrip antennas; and, the stripline fed magnetic microstrip antennas.

BRIEF DESCRIPTION OF THE DRAWINGS

FIG. 1 illustrates a typical dual ground plane coplanar fed electric microstrip antenna.

FIG. 2 shows a cross-section of the antenna of FIG. 1 taken along section 2—2.

FIG. 3 shows an antenna as in FIG. 1 but with a smaller upper ground plane.

FIG. 4 illustrates an array of the type of antenna shown in FIG. 3.

FIG. 5 illustrates a dual ground plane end fed electric microstrip antenna array.

FIG. 26 shows a typical dual ground plane stripline-fed electric microstrip antenna.

FIG. 27 is a cross-sectional view taken along line 27—27 of FIG. 26.

FIG. 28 is an antenna similar to FIG. 26 but with a reduced size upper ground plane.

FIG. 29 illustrates a dual ground plane stripline-fed fan-shaped electric microstrip antenna.

FIG. 30 is a cross-sectional view taken along line 30—30 of FIG. 29.

FIG. 31 shows Return Loss vs. Frequency for a typical antenna as shown in FIGS. 29 and 30.

FIG. 32 illustrates a typical dual ground plane stripline-fed magnetic microstrip antenna.

DESCRIPTION OF THE PREFERRED EMBODIMENTS

Figure 6:
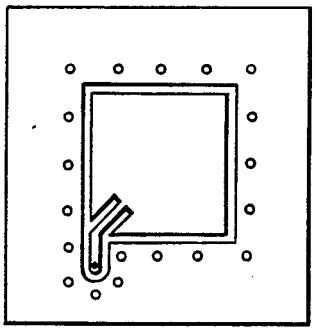
FIG. 6 shows a dual ground plane coplanar notched/diagonally fed electric microstrip antenna.

In the first group of dual ground plane antennas, the radiating elements and the feed system are coplanar with one of the ground planes and the radiating element is of the electric microstrip type. This first type of dual ground plane antennas has a pair of parallel electrically conductive ground planes 10 and 12 equidistantly spaced and separated from each other by a dielectric substrate 14, such as shown in FIGS. 1 and 2. One of the ground planes, e.g., 10 has a conductive area 16 etched therefrom and has a radiating element formed within the area removed. As shown in FIGS. 1 and 2 a notch fed radiating element 15 is formed within the removed area 16; radiating element 15 is thus coplanar with ground plane 10 and spaced above ground plane 12. The radiating element is coplanar fed at feedpoint 17 by a microstrip transmission line 18, etched along with the radiating element within the removed area. Transmission line 18 is in turn connected at 20 to a coaxial-to-microstrip adapter 21. If desired, radiating element 15 can be fed directly from a coaxial-to-microstrip adapter at feedpoint 17. Ground planes 10 and 12 are electrically connected or shorted together by means of a plurality of rivets 23, or electroplated-thru-holes, etc., positioned around the etched out area as shown or in other suitable locations around the upper ground plane which will prevent undesired secondary charge oscillation modes from occurring in the upper ground plane.

Shorting the ground planes together by means of rivets, etc., in the manner shown, substantially prevents secondary radiation from occurring from the upper ground plane 10. Rivets 23 preferably should be spaced apart by much less than one-quarter waveguide wavelength. Also, the position of the rivets is variable. In the design of these dual ground plane antennas and antenna arrays, even when the upper ground plane is shorted to the lower ground plane precautions must be taken not to excite the upper ground plane to radiate due to certain dimensions of the upper ground plane. For example, in FIG. 1, if dimension A is an effective ¼ waveguide wavelength, current oscillation can be induced from the fed radiating element 15 into the portion of upper ground plane 10 along dimension A causing that portion of the upper ground plane to oscillate in the magnetic microstrip mode. Therefore, it is important that the upper ground plane and location of the shorting rivets be designed such that dimension A, for example, is not an effective ¼ waveguide wavelength or a multiple thereof. It is difficult to design a dual ground plane antenna that will operate without any secondary radiation occurring from the upper ground plane, especially when it is coplanar with the radiating element, unless the upper and lower ground planes are shorted to each other. The advantage of such dual ground planes is that they provide a system for improved radiation efficiency, over prior microstrip antennas, when arraying microstrip elements, especially at the higher microwave frequencies. An added advantage when using dual ground planes, where the upper ground plane surrounds the radiating element, is that active and passive circuits (e.g., capacitors, pin diodes, etc.) can be easily mounted between the radiating element and the upper ground plane, in space 16 of FIG. 1 for example.

In some instances, the upper ground plane can be reduced in size without affecting the improved radiation efficiency. In such cases only a partial or smaller upper ground plane may be necessary to reduce current losses of interconnecting transmission lines used for feeding the radiating elements or in arraying microstrip antennas. FIG. 3 shows a dual ground plane coplanar notch fed microstrip antenna where the upper ground plane 30, coplanar with radiating element 31 is smaller than the lower ground plane 32 which extends beneath element 31 and dielectric substrate 34. A reduced size, or two or more piece, upper ground plane is shown in the array of FIG. 4. FIGS. 4 and 5 illustrate typical examples of dual ground plane coplanar fed electric microstrip antenna arrays. In FIG. 4, a plurality of notch fed elements 40, like those in FIG. 3, are interconnected in an array with coplanar microstrip transmission lines 41. The upper ground plane 42 is smaller in area than the lower ground plane, which extends beneath the entire figure of drawing. Upper ground plane surrounds transmission lines 41 in several sections, each of which are shorted to the lower ground plane by rivets 43 for example. Dielectric substrate 44 separates the upper and lower ground planes and spaces elements 40, etc. above the lower ground plane. The array can easily be fed at point 47 from a single source.

In the coplanar fed dual ground plane antennas where the upper ground plane is smaller than the lower ground plane the upper ground plane should always be close to the transmission feed line, such as shown in FIGS. 3 and 4.

Dual ground plane coplanar fed electric microstrip antennas can be fed in various manners. The antenna elements shown in the array of FIG. 5 are coplanar end fed electric microstrip elements 50 with matching microstrip transmission feedlines 51 fed from a single source at 54. As in previously described antennas, the upper ground plane end fed radiating elements are separated from the lower ground plane by a dielectric substrate 55. Matching transmission lines are needed for this type of antenna feed to match the radiating elements to lower source impedances since the input impedance for most practical antenna elements fed at the end is usually high compared to most source impedances. In this array upper ground plane 52 surrounds the radiating elements 50 and coplanar transmission lines 51. The advantage of using the full size upper ground plane array, as in FIG. 5, is that reduced coupling is observed in arrays where radiating elements are spaced very close together.

A dual ground plane coplanar notched/diagonally fed electric microstrip dipole type antenna is shown in FIG. 6.

Figure 7:
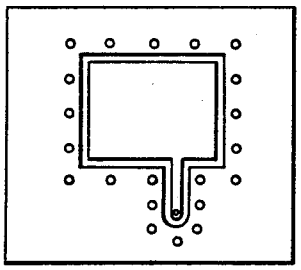
FIG. 7 shows a dual ground plane coplanar offset fed electric microstrip antenna.

The antenna shown in FIG. 7 represents a dual ground plane coplanar offset fed electric microstrip type antenna.

Figure 8:
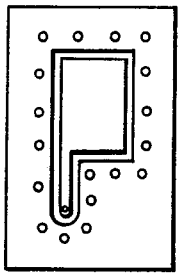
FIG. 8 represents a dual ground plane coplanar corner fed electric microstrip antenna.

A dual ground plane coplanar corner fed electric microstrip dipole antenna with matching microstrip transmission feedline is shown in FIG. 8. This antenna type allows elliptical polarization with only one feedpoint; it also provides flexibility in interconnecting arrays of elements.

Figure 9:
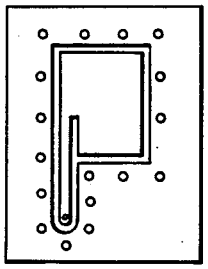
FIG. 9 illustrates a dual ground plane coplanar offset notch fed electric microstrip antenna.

The antenna shown in FIG. 9 is a dual ground plane coplanar offset/notch fed electric microstrip dipole antenna. The offset/notch feedpoint combines the advantage of both the offset fed and notch fed microstrip antenna elements.

Figure 10:
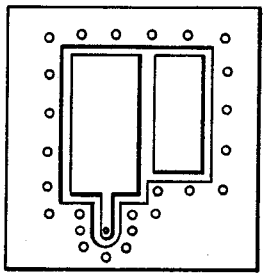
FIG. 10 shows a dual ground plane coplanar coupled fed electric microstrip antenna.

A dual ground plane coplanar coupled fed electric microstrip dipole antenna with microstrip transmission feedline is illustrated in FIG. 10.

Figure 11:
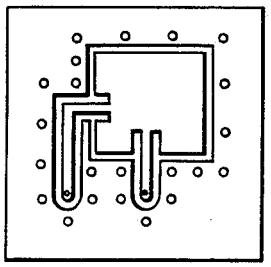
FIG. 11 shows a dual ground plane coplanar dual notch fed electric microstrip antenna.
Figure 12:
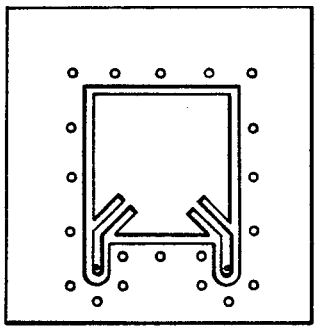
FIG. 12 shows a dual ground plane coplanar dual notched/diagonally fed electric microstrip antenna.

Dual ground plane coplanar dual fed notch and dual fed notched/diagonally fed electric microstrip antennas with microstrip transmission lines are shown in FIGS. 11 and 12, respectively. The types of antenna shown in FIG. 12, for example provide elliptical polarization with only one feedpoint. These antenna types can be made to have a very symmetrical conical radiation pattern.

Figure 13A:
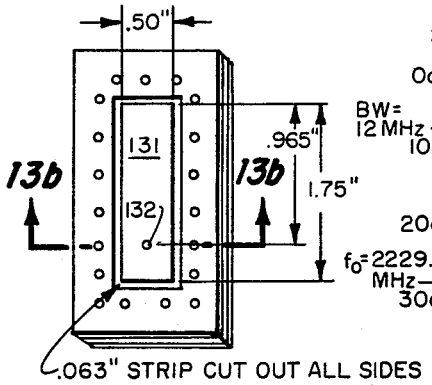
FIG. 13*a* shows a dual ground plane asymmetrically fed electric microstrip antenna.
Figure 14:
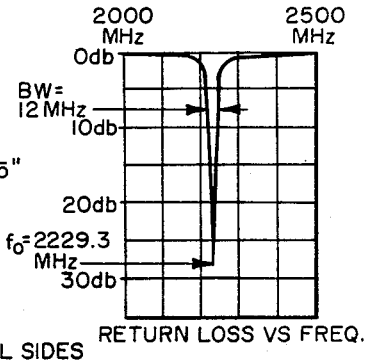
FIG. 14 shows Return Loss vs. Frequency for an antenna as in FIGS. 13*a* and 13*b*.
Figure 13B:
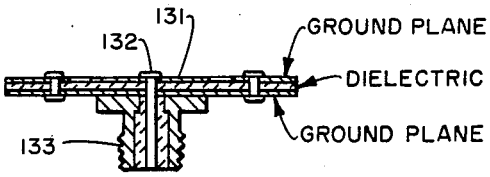
FIG. 13*b* shows a cross-section of the dual ground plane antenna of FIG. 13*a*, taken along section b—b.

FIGS. 13*a* and 13*b* show a dual ground plane asymmetrically fed electric microstrip dipole antenna where the radiating element 131 is fed at feedpoint 132 directly from a coaxial-to-microstrip adapter as shown in FIG. 13*b*. FIG. 14 shows the Return Loss vs. Frequency for the antenna of FIGS. 13*a* and 13*b* with the dimensions given.

The radiation patterns will be substantially the same as for the electric microstrip antennas in the aforementioned related patents and applications, and the design equations disclosed therein are generally applicable to the various similar radiation elements used herein.

As previously pointed out, the upper ground plane should always be located near the area of the transmission line and the spacing of the transmission lines from the upper ground plane should be optimized so that there is minimum transmission loss and minimum radiation loss. Techniques for obtaining such optimum spacing are well known in the art.

The second group of dual ground plane antennas is the dual ground plane coplanar fed magnetic microstrip antennas. In this type of antenna the radiating element and feed system are coplanar with one of the two ground planes and the radiating element is magnetic microstrip (i.e., one end of the radiating element is shorted to ground).

Figure 15:
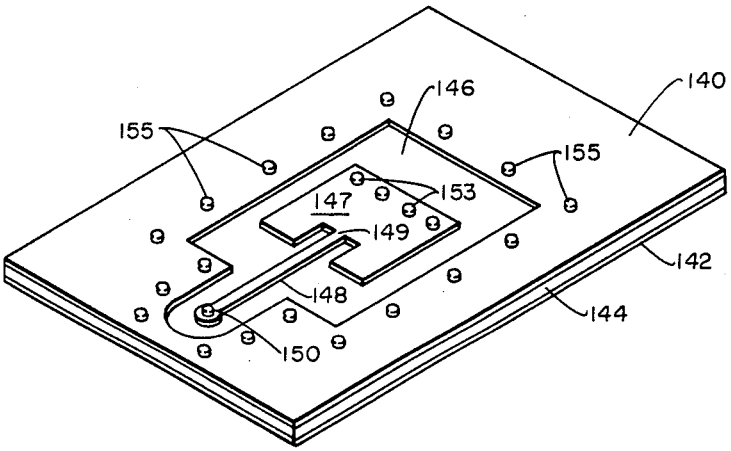
FIG. 15 illustrates a typical dual ground plane coplanar-fed magnetic microstrip antenna.
Figure 16:
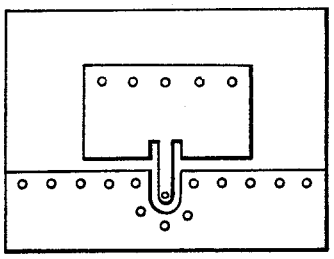
FIG. 16 shows an antenna similar to that of FIG. 15 but with a smaller upper ground plane.
Figure 17:
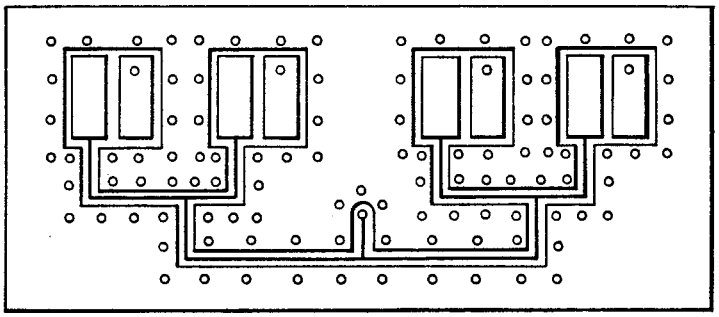
FIG. 17 illustrates a dual ground plane array of coplanar coupled fed magnetic microstrip antennas.

A dual ground plane coplanar notch fed magnetic microstrip antenna is shown in FIG. 15. Similar to FIGS. 1 and 2, FIG. 15 shows two ground planes 140 and 142 are separated by a dielectric substrate 144. Upper ground plane 140 has a portion etched therefrom at 146 and radiating element 147 and transmission line 148 are formed within the area coplanar with ground plane 140. Radiating element 147 is fed at feedpoint 149 with microstrip transmission line 148 which in turn can be fed at its other end 150 from a coaxial-to-microstrip adapter. The radiating element is shorted to the lower ground plane by a row of rivets or plated-thru-holes 153 at one end of the radiating element as shown in FIG. 15. Upper ground plane 140 is conductively connected to lower ground plane 142 by a series of rivets or plated-thru-holes 155 spaced around the etched-out area 146, as shown. The type of antenna shown in FIG. 3, having a smaller upper ground plane, can also be made in the magnetic microstrip type of antenna by shorting the radiating element along one edge such as typically shown in FIG. 16. Dual ground plane coplanar fed magnetic microstrip antennas can also be made with the end fed type of radiating elements, as shown in FIG. 5, shorted to ground along the opposite edge from the feedpoint, thus converting the elements to magnetic microstrip type. A dual ground plane coplanar coupled fed magnetic microstrip array is shown in FIG. 17, by way of example, to show a typical magnetic microstrip antenna array. Any of the electric microstrip type of radiating elements shown in FIGS. 1–5, 8, 9 and 10 can be constructed in the dual ground plane coplanar fed magnetic microstrip type equivalents by shorting one end of the radiating element to ground with rivets, etc., as was done with the radiating elements in FIGS. 15 and 16 and in the manner taught in the aforementioned copending patent applications for Notch Fed; Asymmetrically Fed; Offset Fed and Coupled Fed Magnetic Microstrip Dipole Antennas.

Since two orthogonal modes of charge oscillation cannot take place along the plane of the element in the magnetic microstrip type of antennas, as opposed to the electric microstrip type of antennas, and elliptical polarization therefore is not easily attainable, the dual feed types and diagonally fed types are not included here.

Figure 18:
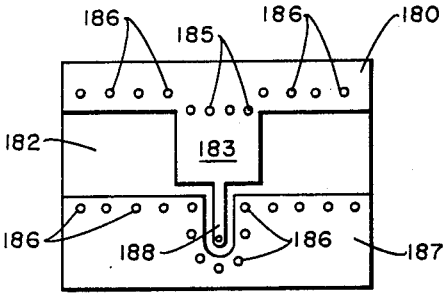
FIG. 18 shows another embodiment for a dual ground plane coplanar-fed magnetic microstrip antenna having a reduced size upper ground plane.

FIG. 18 shows a dual ground plane coplanar end fed magnetic microstrip antenna where the upper ground plane is smaller than the lower ground plane and consists of two portions 180 and 187. Upper ground plane portions 180 and 181 together comprise an area smaller than the lower ground plane, which covers the entire area beneath the figure of drawing, and along with radiating element 183 are spaced from the lower ground plane by dielectric substrate 182. In this instance, the one edge of the magnetic microstrip radiating element 183, which is normally shorted to the lower ground plane, can be etched as a contiguous part of portion 180 of the upper ground plane and shorted by a row of rivets 185 along an imaginary dividing line between upper ground plane portion 180 and the radiating element 183, as shown. The other edges of upper ground plane portions 180 and 187 are shorted to the lower ground plane by rivets, etc., 186, as shown. Transmission line 188 is etched along with radiating element 183. Any of the dual ground plane coplanar-fed magnetic microstrip antennas can be made in this manner if found to be desirable. However, as previously discussed there are other advantages in having the upper ground plane surround the radiating elements. The position of the ground plane shorting rivets and dimensions of the upper ground plane should be such as to avoid undesired secondary charge oscillation modes from occurring, as already discussed.

Figure 19:
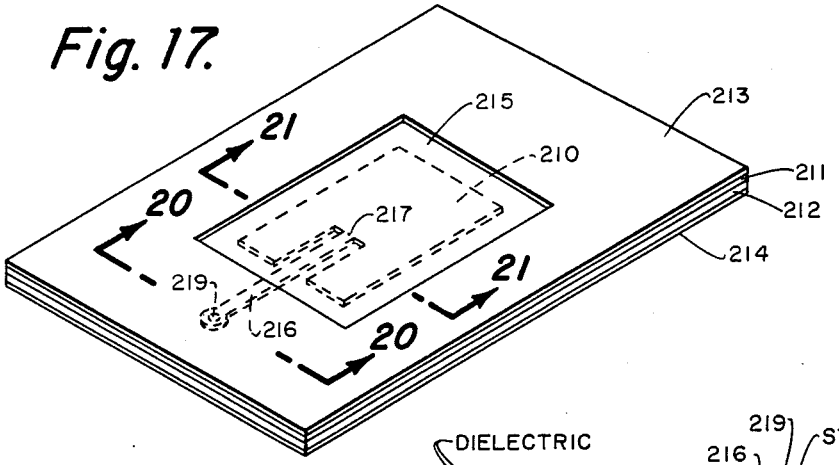
FIG. 19 illustrates a typical dual ground plane stripline-fed windowed electric microstrip antenna.
Figure 20:
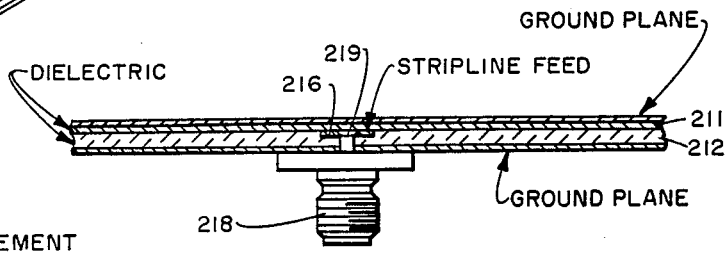
FIG. 20 is a cross-sectional view taken along line 20—20 of FIG. 19.

In the third group of dual ground plane antennas the feed is stripline and the radiation is electric microstrip. In each of these type of antennas the lamination of two copper clad circuit boards is usually required in the manufacturing process. As can be seen from FIGS. 19, 20 and 21, the notch fed radiating element 210 is sandwiched within the dielectric substrate, which is shown as comprising layers 211 and 212, and spaced between both the upper and lower ground planes 213 and 214, respectively. From the upper ground plane 213, for example, a portion 215 is removed which is the same shape and slightly larger in area than the size of the radiating element 210. The area 215 acts as a window through which the radiating element radiates. This type of dual ground plane antenna is usually fed by stripline technique as shown in FIG. 20 where the transmission line 216 is sandwiched between the dielectric substrate layers 211 and 212 which separate the upper and lower ground planes 213 and 214, respectively, and feeds the radiating element at feedpoint 217. This arrangement allows lower losses at higher microwave frequencies. The other end of the transmission line 216 can be connected to a coaxial-to-stripline launcher 218 at 219, or sandwiched with a plurality of antenna elements in an array as typically shown in FIGS. 4, 5 and 17 for example. In this type of antenna, ground plane 213 and ground plane 214 are not required to be shorted together for some applications; however, in the majority of instances it is recommended that both ground planes be shorted to the flange of the coaxial-to-stripline launcher. When the ground planes are shorted together there is an added advantage in that this tends to reduce coupling between closely spaced radiating elements in an array. For some configurations of the upper ground plane, shorting of the two ground planes is preferable in order to eliminate undesired secondary radiation due to ground plane excitation. Ground plane excitation can be caused, in some instances, by current excitation from the radiating element on the upper ground plane when the ground plane is of a certain size and form factor which permits this to occur, such as disclosed earlier. Such a situation can easily be alleviated by choosing the proper size or form factor for the upper ground plane, or by shorting the upper ground plane to the lower ground plane as shown in FIGS. 22 and 23, for example. FIG. 22 shows a dual ground plane stripline notch-fed windowed electric microstrip antenna with the upper and lower ground planes shorted together. FIG. 23 is similar to FIG. 22 except that the upper ground plane is smaller than that in FIG. 22.

Figure 21:
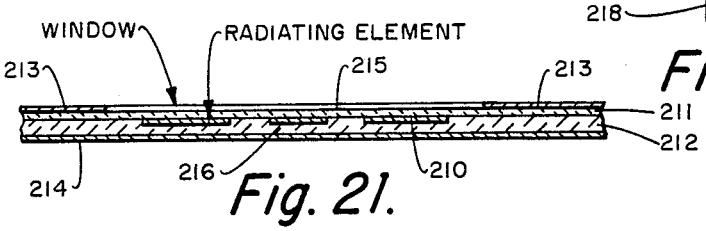
FIG. 21 is a cross-sectional view taken along line 21—21 of FIG. 19.
Figure 22:
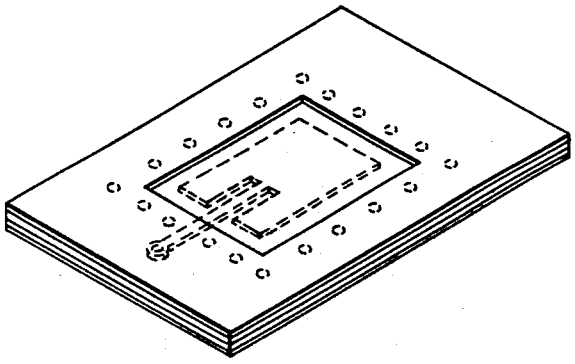
FIG. 22 shows an antenna as in FIG. 19 but with the two ground planes shorted together.
Figure 23:
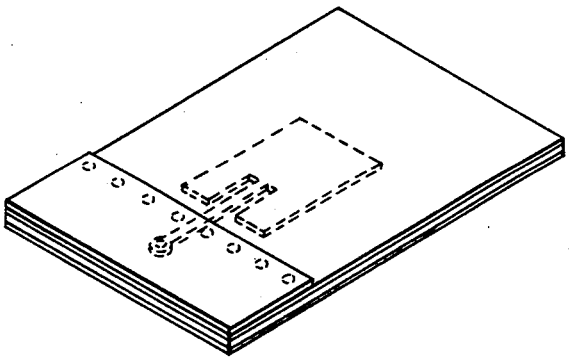
FIG. 23 also shows an antenna as in FIG. 22, but with a smaller upper ground plane.

Radiating elements, such as the asymmetrically fed and diagonally fed elements, which are fed directly at their feedpoint from a coaxial-to-microstrip adapter from the lower ground plane side, can also be made in the same manner as the notch fed antenna examples shown in FIGS. 21 and 22, sandwiched within the dielectric substrate between two ground planes with a radiation window in one ground plane but without a stripline feed. However, there appears to be no reduction in transmission line losses for these direct fed type of antennas although there appears to be a reduction in coupling between different closely spaced elements in an array, designed in this manner, especially when the ground planes are shorted together around the window area. When the ground planes are not shorted together there may or may not be a reduction in coupling between closely spaced radiation elements depending upon the configuration of the window and/or upper ground plane. In addition, there are advantages in the feedpoint location for circular polarization, providing flexibility in arraying elements, etc. When arraying this type of antenna it may be desired, in some instances, to have the radiation windows for some radiating elements in one ground plane and radiation windows for the other radiating elements in the other ground plane. This would permit coaxial adapters to be located on either the upper or lower ground planes. Tuning capacitors can likewise be located in either the upper or lower ground planes, as discussed in aforementioned copending application, Ser. No. 712,994.

Tuning tabs or side wing extensions which are used for reactive loading of the radiating elements, as discussed in copending applications, Ser. No. 740,690 and Ser. No. 740,694, aforementioned, can also be used with the radiating elements of the dual ground plane type microstrip antennas discussed herein. However, to reduce excitation of the windowed ground plane the window should also include the area of the tuning tab. Spacing between the radiating element and lower ground plane affects the bandwidth of the stripline-fed windowed microstrip antennas; the larger the spacing the greater the bandwidth.

Figure 24:
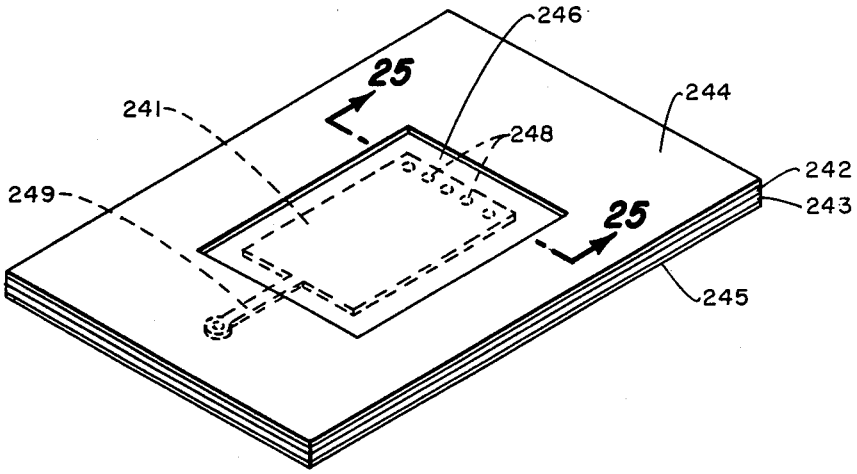
FIG. 24 illustrates a dual ground plane stripline-fed windowed magnetic microstrip antenna.
Figure 25:
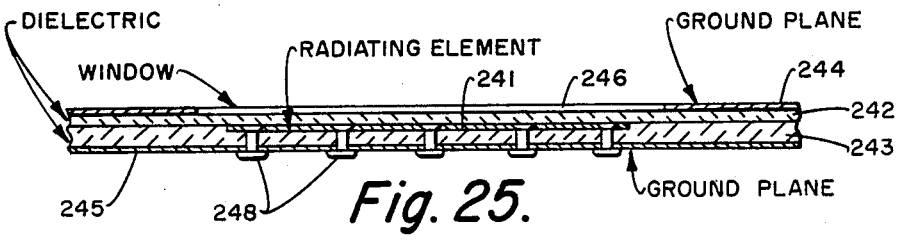
FIG. 25 is a cross-sectional view taken along line 25—25 of FIG. 24.

The fourth group of dual ground plane antennas is similar to the third group with the exception that the radiating element has one end shorted to one of the ground planes and the radiation is magnetic microstrip. Any of the radiating elements, such as shown in FIGS. 1–5, 7, 9 and 10 can also be made in stripline fed magnetic microstrip equivalents by shorting one end of the radiating element to ground and constructing the antenna in the general manner as discussed below. A typical such antenna, for example, is shown in FIGS. 24 and 25 where an end fed radiating element 241 is sandwiched within dielectric substrate layers 242, 243 between upper ground plane 244 and lower ground plane 245. Window 246 is formed in upper ground plane 244 by etching away or otherwise removing from the conductive ground plane surface a portion that is somewhat larger than the size of the radiating element 241. One edge of the radiating element is grounded by rivets 248, for example, to lower ground plane 245. A stripline feedline 249 is etched along with radiating element 241, and for the end fed radiating element shown the feedline must match the radiating element to a lower source impedance, as previously explained. Since two orthogonal modes of charge oscillation cannot take place along the plane of the magnetic microstrip element, elliptical polarization is not easily attainable as it is in the electric microstrip elements.

The windowed dual ground plane electric microstrip and magnetic microstrip antennas can also be arrayed in a manner as typically shown in FIG. 5 for the coplanar fed microstrip antennas. These antennas and antenna arrays can readily be made to wrap around aircraft bodies and other irregular surfaces as mentioned in the foregoing patents and copending applications. In this type of antenna, as in those already discussed, upper ground plane dimensions and location of any ground plane shorting rivets should be such as to avoid secondary charge oscillation.

The fifth group of dual ground plane antennas is that of the stripline-fed electric microstrip antennas. In this type of microstrip antenna the radiating element is coplanar with the upper ground plane with the upper and lower ground planes shorted together, as in the first group of dual ground plane antennas. However, the radiating element is fed with a stripline transmission line within the dielectric substrate and sandwiched between the two ground planes as shown in FIGS. 26 and 27. As mentioned previously, the stripline feed technique with dual ground planes provides the greatest reduction in transmission line leakage losses over the prior art microstrip antennas. Illustrated in FIGS. 26 and 27 is a notch fed rectangular radiating element 261, for example, formed coplanar with ground plane 262 and separated from ground plane 262 by removed area 263. Radiating element 261 and ground plane 262 are spaced apart from ground plane 264 by dielectric substrate layers 265 and 266. Ground plane 262 is shorted to ground plane 264 by means of rivets 267 or shorted-thru-holes, etc. The notched radiating element 261 is fed at its feedpoint 268 by stripline transmission line 269 sandwiched between dielectric substrate layers 265 and 266, and between the upper and lower ground planes 262 and 264. Stripline transmission line 269 is connected to feedpoint 268 by means of a short rivet 270, as shown in FIG. 27. The other end 272 of stripline transmission line 269 can be connected to a coaxial-to-stripline connector in the manner as shown in FIG. 20 or a plurality of antenna elements can be arrayed, similar to the arrays shown in FIGS. 4, 5 and 17, with stripline transmission line as shown herein. The lamination of two circuit boards is usually preferred in the manufacturing process as the simplest way to produce this sandwiched type of configuration using stripline technique, although any other suitable techniques can be used. This type of antenna provides a wider band, over that of the window type, and maintains lower transmission line losses over the coplanar-fed microstrip type of antennas disclosed herein. The upper ground plane, for certain applications can be made smaller, as shown in FIG. 28, in a manner similar to that done for the antenna of FIG. 3.

FIGS. 29 and 30 show a dual ground plane stripline end fed fan shaped electric microstrip dipole antenna. In this example, the upper ground plane is shown shorted to the lower ground plane about the configuration of the upper ground plane. FIG. 30 shows the antenna configuration curved to conform to a curved surface, for example, since all these thin type antennas are readily conformable to other than merely flat surfaces.

As shown in FIGS. 29 and 30 for this example, the radiating element 291 is coplanar with ground plane 292 and separated from ground plane 293 by two laminated layers 294 and 295 of dielectric substrate. Rivets 297 short the two ground planes together. A short length of matching stripline transmission line 298 is connected at one end to the radiating element feedpoint by a short rivet 300. The opposite end of the stripline transmission line is connected to the center pin 303 of a coaxial-to-microstrip adapter 304. A plurality of these antennas can be arrayed with stripline transmission line and fed at a common junction if desired. FIG. 31 shows typical Return Loss vs. Frequency measurements for an antenna such as shown in FIG. 29.

The dual ground plane stripline-fed technique also can be used to feed electric microstrip antenna radiating elements such as the diagonally fed, notched/diagonally fed, offset fed, notched/offset feed, end fed, asymmetrically fed, coupled fed, etc., elements used in various of the dual ground plane microstrip antennas discussed above and disclosed in the aforementioned patents and copending applications, and using upper ground plane dimensioning and shorting rivet locations as already discussed.

The sixth group of dual ground plane antennas are similar to those in the fifth group, but the radiating elements are of the magnetic microstrip type where one end of the radiating element is shorted to at least one of the ground planes. A typical such antenna is shown in FIG. 32 illustrating a dual ground plane stripline notch fed magnetic microstrip antenna. The radiating element 321 notched to the feedpoint 322 is formed coplanar with the upper ground plane 323 and separated from the lower ground plane 324 by dielectric substrate 325 and 326. A stripline transmission line 327 is sandwiched within layers of dielectric substrate between the two ground planes and connected to feedpoint 322, in a similar manner to that shown in FIGS. 27 and 30. The upper and lower ground planes 323 and 324 are shorted together by rivets 328. This type of dual ground plane antenna can be made with all the various types of radiating elements already discussed with regard to those of the second group, i.e., FIGS. 15, 16, 17 and 18 and similar antennas, which use microstrip coplanar transmission lines. The stripline feed technique, however, as aforementioned, provides the greatest reduction in transmission line leakage losses over the prior art microstrip antennas especially at higher microwave frequencies. These antennas can be arrayed as typically shown in FIGS. 4, 5 and 17, but with stripline transmission lines rather than microstrip transmission lines.

Figure 33:
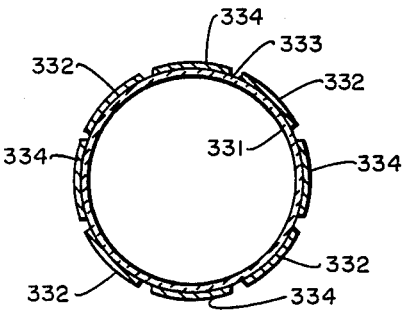
FIG. 33 illustrates a cylindrical array of dual ground plane microstrip antennas for providing a near isotropic radiation pattern.

By arraying a plurality of radiating elements about a cylindrical ground plane, for example, and feeding each of the elements, in phase with each other, a near isotropic radiation pattern can be produced. Depending upon the radiating pattern of the individual radiation elements used, an analysis can determine the optimum number of radiation elements needed for specific cylinder diameters to give an overall near isotropic radiation pattern. FIG. 33, for example, illustrates in cross-section, a cylindrical inner ground plane 331 spaced apart from an outer ground plane 332 by dielectric substrate 333. A plurality of radiating elements 334, coplanar with ground plane 332 are positioned about the cylinder and arrayed with stripline or microstrip transmission line, as previously discussed, to provide near isotropic radiation. Any of the various of dual ground plane antennas discussed herein can be arrayed in this general manner about a cylindrical or other shaped surface as a wrap-around type of microstrip antenna.

Proper dimensioning of the upper ground plane and/or strategic shorting of the upper ground plane at various locations to the lower ground plane, as discussed herein, eliminates induced current or charge oscillation on the upper ground plane thereby avoiding undesirable radiation from the upper ground plane including undesirable cross-polarization radiation.

Obviously many modifications and variations of the present invention are possible in the light of the above teachings. It is therefore to be understood that within the scope of the appended claims the invention may be practiced otherwise than as specifically described.

What is claimed is:

1. A dual ground plane stripline-fed windowed electric microstrip antenna having low physical profile and conformal arraying capability, comprising:

a. a pair of thin conducting parallel ground planes;

b. a dielectric substrate separating and spacing apart said pair of ground planes one from the other to provide an upper ground plane and a lower ground plane;

c. a thin electrically conducting radiating element having at least one feedpoint thereon being surrounded on all surfaces by and positioned completely within said dielectric substrate in a plane noncoplanar with but sandwiched in between and parallel to each one of said pair of ground planes; said radiating element being spaced from and being electrically separated from said ground planes by said dielectric substrate;

d. a stripline transmission line having one end thereof electrically connected to said at least one radiating element feedpoint to excite said radiating element to radiate; said stripline transmission line also being surrounded on all surfaces by and positioned within said dielectric substrate, and being noncoplanar with and electrically separated from said ground planes;

e. a conductive area being removed from one of said pair of ground planes directly opposite to said radiating element to form a window of at least the same size and shape as said radiating element through which said radiating element radiates upon being excited; said window itself being nonradiating whereas radiation emanating from said radiating element within the dielectric substrate radiates therethrough; the area and shape of said windowed ground plane being dimensioned to prevent undesired induced currents and secondary charge oscillation modes from occurring in portions of said windowed ground plane;

f. said dual ground planes with said microstrip radiating element sandwiched therebetween operating to cause a reduction in transmission line leakage losses from said stripline transmission line without adversely affecting the operation of said microstrip radiating element.

2. A dual ground plane electric microstrip antenna as in claim 1 wherein the window in said one ground plane is slightly larger in size than said radiating element.

3. A dual ground plane electric microstrip antenna as in claim 1 wherein the two ground planes are shorted together by a plurality of electrically conductive shorting means; said shorting means being spaced about said windowed ground plane and strategically positioned to avoid having any portion of said windowed ground plane between said shorting means and a free edge thereof from being dimensioned nearly equal to an effective ¼ waveguide wavelength or multiples thereof; said shorted windowed ground plane further operating to reduce coupling between closely spaced radiating elements when in an array and to prevent undesired secondary radiation from occurring for some configurations of said windowed ground plane.

4. A dual ground plane electric microstrip antenna as in claim 1 wherein said radiating element is notch fed.

5. A dual ground plane electric microstrip antenna as in claim 1 wherein said radiating element is corner fed.

6. A dual ground plane electric microstrip antenna as in claim 1 wherein said radiating element is end fed.

7. A dual ground plane electric microstrip antenna as in claim 1 wherein said radiating element is offset fed.

8. A dual ground plane electric microstrip antenna as in claim 1 wherein said radiating element is offset/notch fed.

9. A dual ground plane electric microstrip antenna as in claim 1 wherein said radiating element is notched/diagonally fed.

10. A dual ground plane electric microstrip antenna as in claim 1 wherein said radiating element is coupled fed.

11. A dual ground plane electric microstrip antenna as in claim 1 wherein said radiating element is dual notch fed using two stripline transmission lines to feed two feedpoints.

12. A dual ground plane electric microstrip antenna as in claim 1 wherein said radiating element is dual notched/diagonally fed using two stripline transmission lines to feed two feedpoints.

13. A dual ground plane electric microstrip antenna as in claim 1 wherein said stripline transmission line is omitted and said radiating element is asymmetrically fed directly at the feedpoint from a coaxial-to-microstrip adapter.

14. A dual ground plane electric microstrip antenna as in claim 1 wherein said stripline transmission line is omitted and said radiating element is diagonally fed directly at the feedpoint from a coaxial-to-microstrip adapter.

15. A dual ground plane electric microstrip antenna as in claim 1 wherein said stripline transmission line is omitted and said radiating element is dual asymmetrically fed directly at the two feedpoints from two coaxial-to-microstrip adapters.

16. A dual ground plane electric microstrip antenna as in claim 1 wherein said stripline transmission line is omitted and said radiating element is dual diagonally fed directly at the two feedpoints from two coaxial-to-microstrip adapters.

17. A dual ground plane electric microstrip antenna as in claim 1 wherein a plurality of said radiating elements, having respective radiation windows in at least one of said pair of ground planes, are arrayed with stripline transmission lines within said dielectric substrate.

18. A dual ground plane electric microstrip antenna as in claim 17 wherein said array is conformed to a wrap-around configuration and said plurality of radiating elements provide a near isotropic radiation pattern.

19. A dual ground plane electric microstrip antenna as in claim 1 wherein said windowed ground plane is much smaller in size than the other ground plane, and a large portion of the windowed ground plane is removed with the exception of that portion of said windowed ground plane which extends over the area of said transmission line.

20. A dual ground plane electric microstrip antenna as in claim 19 wherein a plurality of said radiation elements are arrayed with interconnecting stripline transmission lines within said dielectric substrate.

21. A dual ground plane electric microstrip antenna as in claim 1 wherein said antenna is fed electrical energy between said feedpoint and said lower ground plane.

22. A dual ground plane electric microstrip antenna as in claim 1 wherein the spacing between said radiating element and said lower ground plane is varied for changing the antenna bandwidth.

23. A dual ground plane electric microstrip antenna as in claim 3 wherein the conducting area removed from said one ground plane extends to all but the conducting area at the end of said one ground plane over said transmission line in the area where said transmission line feeds said radiating element.

24. A dual ground plane electric microstrip antenna as in claim 23 wherein a plurality of said radiation elements are arrayed with interconnecting stripline transmission lines within said dielectric substrate.

25. A dual ground plane stripline-fed windowed magnetic microstrip antenna having low physical profile and conformal arraying capability, comprising:

a. a pair of thin conducting ground planes;

b. a dielectric substrate separating and spacing apart said pair of ground planes one from the other;

c. a thin electrically conducting radiating element having a feedpoint thereon positioned between said pair of ground planes within said dielectric substrate and electrically separated from said ground planes by said dielectric substrate; said radiating element having one edge thereof shorted to one of said ground planes by at least one radiating element shorting means;

d. a stripline transmission line having one end thereof electrically connected to said radiating element feedpoint; said stripline transmission line also being positioned within and electrically separated from said ground planes;

e. a conductive area being removed from one of said pair of ground planes to form a window through which said radiating element can radiate upon being excited;

f. said dual ground planes operating to cause a reduction in transmission line leakage losses from said stripline transmission line without adversely affecting the operation of said microstrip radiation element, and said windowed ground plane being dimensioned to prevent charge oscillation modes from occurring in portions thereof.

26. A dual ground plane magnetic microstrip antenna as in claim 25 wherein said window in a ground plane is slightly larger in size than said radiating element.

27. A dual ground plane magnetic microstrip antenna as in claim 25 wherein the two ground planes are shorted together by a plurality of electrically conductive shorting means; said shorting means being spaced about said windowed ground plane and positioned to avoid having any portion of said windowed ground plane between said shorting means and a free edge thereof from being dimensioned nearly equal to an effective $\frac{1}{4}$ waveguide wavelength or multiple thereof; said shorted windowed ground plane also operating to reduce coupling between closely spaced radiating elements when in an array and prevent undesired secondary radiation from occurring for some configurations of said windowed ground plane.

28. A dual ground plane magnetic microstrip antenna as in claim 25 wherein said radiation element is notch fed.

29. A dual ground plane magnetic microstrip antenna as in claim 25 wherein said radiating element is end fed.

30. A dual ground plane magnetic microstrip antenna as in claim 25 wherein said radiating element is offset fed.

31. A dual ground plane magnetic microstrip antenna as in claim 25 wherein said radiating element is offset/-notch fed.

32. A dual ground plane magnetic microstrip antenna as in claim 25 wherein said radiating element is coupled fed.

33. A dual ground plane magnetic microstrip antenna as in claim 25 wherein said stripline transmission line is omitted and said radiating element is asymmetrically fed directly at the feedpoint from a coaxial-to-microstrip adapter.

34. A dual ground plane magnetic microstrip antenna as in claim 25 wherein a plurality of said radiating elements, having respective radiation windows in at least one of said pair of ground planes, are arrayed with interconnecting stripline transmission lines within said dielectric substrate.

35. A dual ground plane magnetic microstrip antenna as in claim 34 wherein said array is conformed to a wrap-around configuration and said plurality of radiating elements provide a near isotropic radiation pattern.

36. A dual ground plane magnetic microstrip antenna as in claim 25 wherein a large portion of said windowed ground plane is removed with the exception of that portion thereof which extends over the area of said stripline transmission line.

37. A dual ground plane magnetic microstrip antennas as in claim 36 wherein a plurality of said radiating elements are arrayed with interconnecting stripline transmission lines within said dielectric substrate.

* * * * *